US006481316B1

(12) United States Patent
Liao

(10) Patent No.: US 6,481,316 B1
(45) Date of Patent: Nov. 19, 2002

(54) PAWL SHIFTING MECHANISM FOR RATCHET TOOLS

(76) Inventor: I-He Liao, 11F-2, No. 34, Chai-I Street, Taichung City (TW)

( * ) Notice: Subject to any disclaimer, the term of this patent is extended or adjusted under 35 U.S.C. 154(b) by 44 days.

(21) Appl. No.: 09/967,380

(22) Filed: Oct. 1, 2001

(51) Int. Cl.[7] ..... B25B 13/46
(52) U.S. Cl. ..... 81/63; 81/63.2; 81/62
(58) Field of Search ..... 81/63, 63.1, 63.2, 81/62

(56) References Cited

U.S. PATENT DOCUMENTS 4,254,675 A * 3/1981 Marlow et al. ..... 81/63
4,274,311 A * 6/1981 Ebert ..... 81/63
4,277,989 A * 7/1981 Tracy ..... 81/62
4,967,624 A * 11/1990 Farris ..... 81/63
5,957,008 A * 9/1999 Long ..... 81/63
6,314,839 B1 * 11/2001 Carter ..... 81/63

* cited by examiner

*Primary Examiner*—James G. Smith
*Assistant Examiner*—Hai Shakeri
(74) *Attorney, Agent, or Firm*—Charles E. Baxley

(57) ABSTRACT

A ratchet tool includes a handle and a head in which an engaging member is received therein and a pawl is engaged with the engaging member. A link is pivotably received in the handle. A first end of the link is engaged with the pawl and a second end of the link is connected to a control member which is rotatably mounted to the handle. An intermediate portion of said link is pivotally connected to a base member in the handle.

4 Claims, 3 Drawing Sheets

PAWL SHIFTING MECHANISM FOR RATCHET TOOLS

FIELD OF THE INVENTION

The present invention relates to a ratchet tool that has a shifting member on the handle for the user to shift the pawl of the ratchet mechanism without removing the hand to the head of the tool.

BACKGROUND OF THE INVENTION

A conventional ratchet tool generally includes a head with a ratchet mechanism is received therein and a handle connected to the head. The ratchet mechanism includes a toothed engaging member and a pawl which is engaged with the teeth of the toothed engaging member. The pawl is controlled by a pawl shifting mechanism which generally is a lever on a surface of the head so that the user shifts the lever to change the position that the pawl is engaged with the engaging member. Generally, it requires the user to use the other hand other than the hand holding the handle to operate the lever. In other words, when the user wants to change the position of the pawl, he/she users both of his/her two hands to operate the process. In some situations, it is not convenient for the user to use both of his/her hand to operate the process.

SUMMARY OF THE INVENTION

In accordance with one aspect of the present invention, there is provided a ratchet tool which includes a handle and a head. An engaging member is received in the head and a pawl is engaged with the engaging member. A link has a first end thereof engaged with the pawl and a second end of the link is connected to a control member. An intermediate portion of the link is pivotally connected to the handle of the tool so that the pawl is shifted by pivoting the link by operation the control member which is rotatably mounted the handle.

The primary object of the present invention is to provide a ratchet tool whose effective operation direction can be changed by rotating a control member on the handle.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
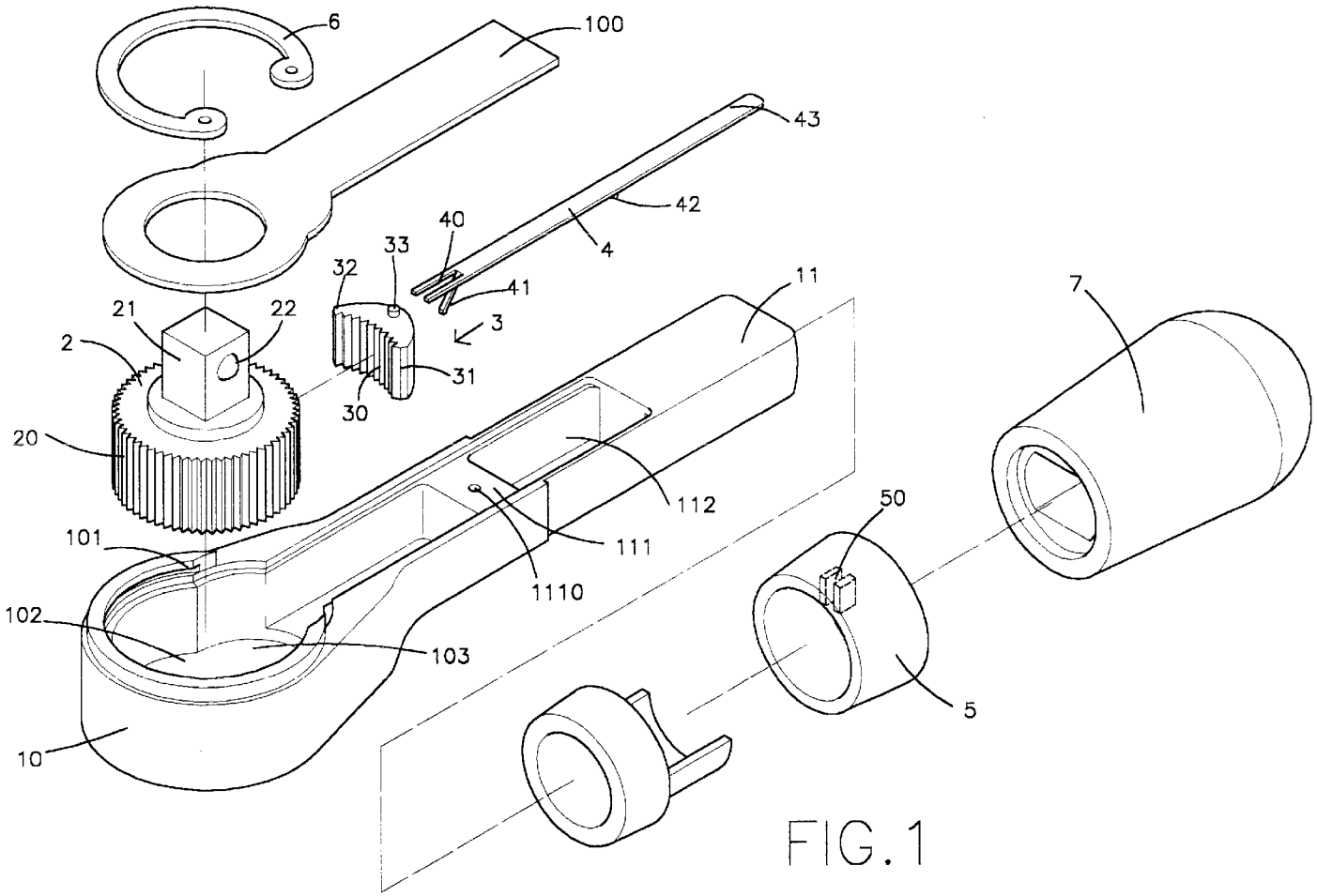
FIG. 1 is an exploded view to show the ratchet tool of the present invention.

Referring to FIGS. 1, 2, 5 and 8, the ratchet tool of the present invention comprises a handle 11 and a head 10 which has a recess 102 defined in a side thereof so as to receive an engaging member 2 therein. A pawl 3 is received in another space 103 in the head 10 and communicates with the recess 102. The pawl 3 is engaged with a toothed portion 20 of the engaging member 2. Teeth 30 are defined in a surface of the pawl 3 and a protrusion 33 extends from a top surface of the pawl 3. The engaging member 2 has the toothed portion 20 and an engaging shaft 21 extends from a surface of the toothed portion 20. A bead 22 is embedded in the engaging shaft 21. The handle 11 has a chamber 112 defined therein and a base member 111 is located in the handle 11 and between the chamber 112 and the space 103 in the head 10. A cover 100 is connected to the head 10 by a C-shaped clamp 6 which is engaged with a groove 101 in an inner periphery of the recess 102.

A link 4 has a nipple 42 on an intermediate portion thereof and the nipple 42 is pivotably engaged with a recess 1110 defined in the base member 111. A first end of the link 4 is a fork 40 which is engaged with the protrusion 33 on the pawl 3. A second end 43 of the link 4 is connected to a control member 5. The control member 5 is a collar which is rotatably mounted to the handle 11 away from the head 10 and a clamp member 50 is connected to an inner periphery of the control member 5. The second end 43 of the link 4 is clamped to the clamp member 50. An end piece 7 is mounted to a distal end of the handle 11. A support rod 41 extends from an underside of said link 4 and contacts said pawl 3.

Figure 2:
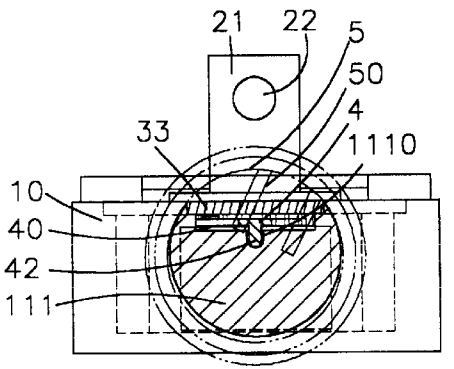
FIG. 2 is an end view to show the link and the pawl at a first position of the chamber in the handle of the ratchet tool.
Figure 8:
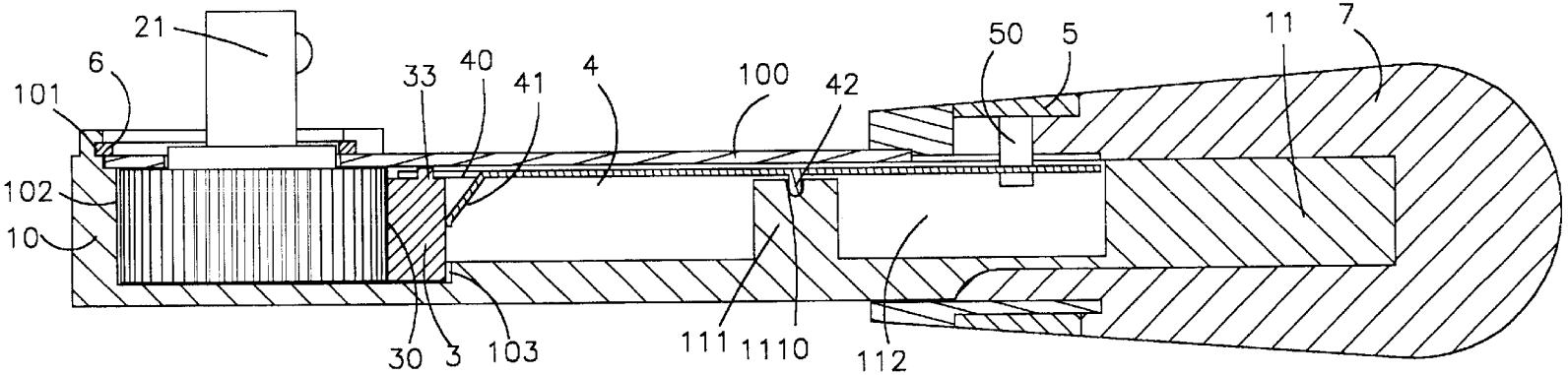
FIG. 8 is a side cross sectional view to show the ratchet tool of the present invention.
Figure 5:
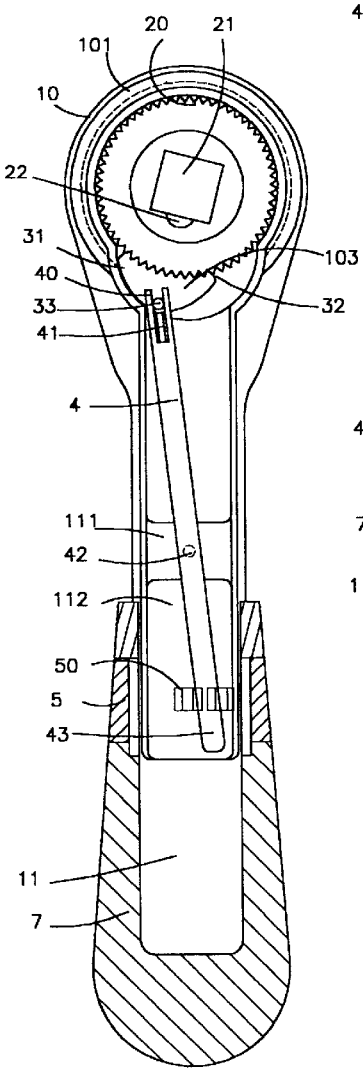
FIG. 5 is a plan view to show the positions of the link and the pawl as shown in FIG. 2.

When the control member 5 is rotated to a first position as shown in FIGS. 2 and 5, an end 31 of the pawl 3 contacts against an inside of the space 103 so that the ratchet tool is able to output a torque when rotating counter clockwise.

Figure 4:
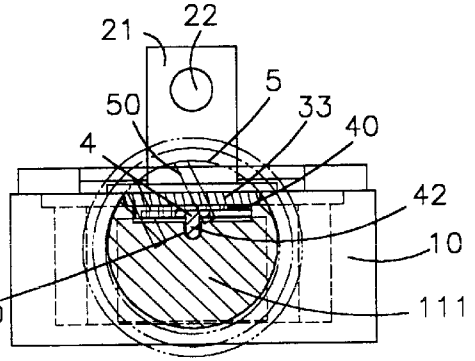
FIG. 4 is an end view to show the link and the pawl at a second position of the chamber in the handle of the ratchet tool.
Figure 3:
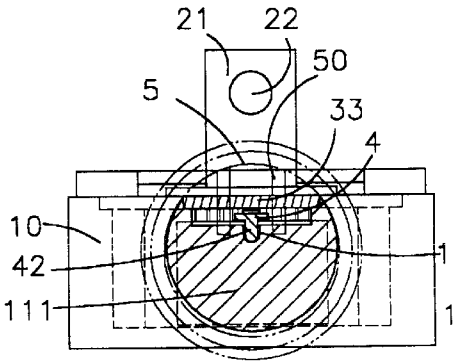
FIG. 3 is an end view to show the link and the pawl at a central position of the chamber in the handle of the ratchet tool.
Figure 6:
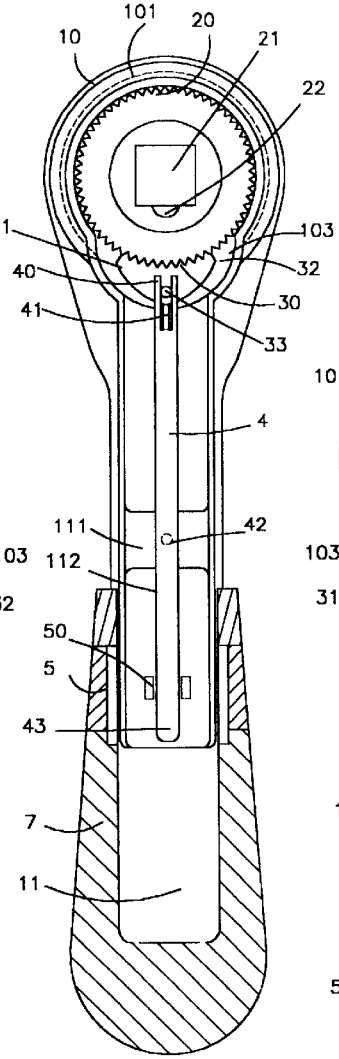
FIG. 6 is a plan view to show the positions of the link and the pawl as shown in FIG. 3.
Figure 7:
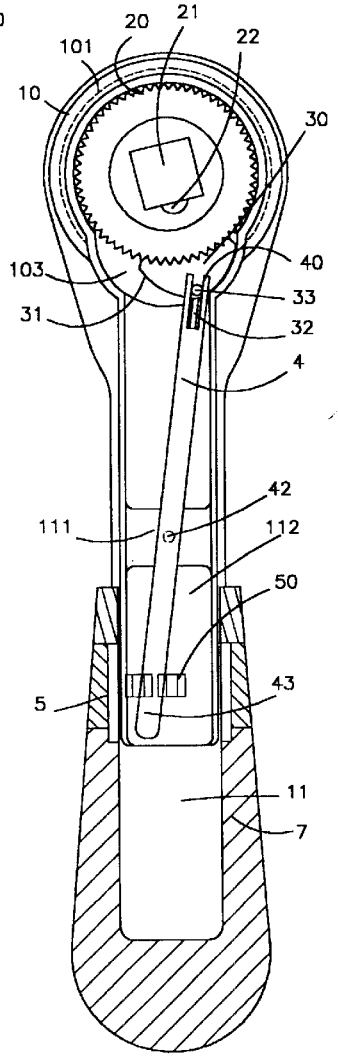
FIG. 7 is a plan view to show the positions of the link and the pawl as shown in FIG. 4.

As shown in FIGS. 3 and 6, when rotating the control member 5 to a central or neutral position, the two ends 31, 32 of the pawl 3 do not contact the inside of the space 103 so that no torque is output. As shown in FIGS. 4 and 7, when rotating the control member 5 to a second position, the end 32 of the pawl 3 contacts against the inside of the space 103 so that the ratchet tool is able to output a torque when rotating clockwise. The support rod 41 of the link 4 has slightly flexibility so as to allow the pawl 3 to be moved toward the link 4 and to deform the support rod 41 slightly such that the teeth 30 on the pawl 3 are moved over the teeth of the toothed portion 20 of the engaging member 2. The bounce force of the support rod 41 will eventually push the pawl 3 to re-engage the teeth of the toothed portion 20 again when the tool is rotated in a direction opposite the direction that can output a torque.

While we have shown and described the embodiment in accordance with the present invention, it should be clear to those skilled in the art that further embodiments may be made without departing from the scope of the present invention.

What is claimed is:

1. A ratchet tool comprising:

a handle and a head, an engaging member received in said head and a pawl engaged with said engaging member, said pawl having a protrusion extending from a surface thereof, and a link having a fork on a first end thereof and said fork engaged with said protrusion of said pawl and a second end of said link connected to a control member which is rotatably mounted to said handle.

2. The ratchet tool as claimed in claim 1, wherein said handle has a chamber defined therein and a base member is located between said chamber and an interior of said head, an intermediate portion of said link pivotally connected to said base member.

3. The ratchet tool as claimed in claim 2, wherein said control member is a collar which is rotatably mounted to said handle and a clamp member is connected to an inner periphery of said control member, said second end of said link clamped to said clamp member.

4. The ratchet tool as claimed in claim 1 further comprising a support rod extending from said link and contacting said pawl.

* * * * *